US008495965B1

(12) United States Patent
Hadida et al.

(10) Patent No.: US 8,495,965 B1
(45) Date of Patent: Jul. 30, 2013

(54) SUBSURFACE SPLASH GENERATOR

(75) Inventors: Joseph Hadida, Yardley, PA (US); David B. Arnal, Mount Laurel, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 447 days.

(21) Appl. No.: 12/616,338

(22) Filed: Nov. 11, 2009

(51) Int. Cl.
*B63G 8/14* (2006.01)

(52) U.S. Cl.
USPC ..... 114/331; 239/20; 239/23

(58) Field of Classification Search
USPC ..... 114/312, 331; 441/130; 472/128, 472/134; 239/20, 16, 17, 18, 23
See application file for complete search history.

(56) References Cited

U.S. PATENT DOCUMENTS 2,696,105 A 12/1954 Mackas
2,974,872 A * 3/1961 Rodman ..... 239/20
4,479,378 A 10/1984 Malakhoff
5,510,022 A * 4/1996 Mullis ..... 239/20
5,531,113 A 7/1996 Jamison
5,862,984 A * 1/1999 Chang ..... 239/20
6,119,957 A * 9/2000 Liu ..... 239/17
7,275,691 B1 10/2007 Wright et al.

OTHER PUBLICATIONS

H613 United States Statutory Invention Registration: Portable Shipboard Gunnery Training/Diagnostic Apparatus, Samuel L. Stello, James M. Johnson, J. Harold Jones, Published Apr. 4, 1989.

* cited by examiner

*Primary Examiner* — Lars A Olson
(74) *Attorney, Agent, or Firm* — Howard IP Law Group, P.C.

(57) ABSTRACT

A submersible apparatus is configured to eject air and/or water in desired predetermined patterns to simulate particular types of ordnance to facilitate safe and effective splash testing of ship radar systems. The apparatus includes a frame, one or more adjustable buoyancy bodies, a source of fluid such as an air compressor or a water pump, and a plurality of nozzles through which the fluid is ejected to create the desired splash. Fluid can be supplied to the buoyancy bodies to adjust the level of the apparatus in the water as necessary to simulate a particular type of ordnance. Additionally, the nozzles can be individually adjustable to facilitate ordnance simulation. A control system is provided to enable remote and/or preprogrammed control of the apparatus. A wireless or hard wired link can be provided to allow a remote user to control the apparatus in real time.

33 Claims, 4 Drawing Sheets

SUBSURFACE SPLASH GENERATOR

FIELD OF THE DISCLOSURE

The invention relates generally to the field of ship systems testing, and more particularly to a system for simulating ordnance splashes for testing of ship combat systems.

BACKGROUND OF THE DISCLOSURE

One of the critical items verified during US Navy testing at sea is the ability of the vessel sensors to maintain track continuity in the presence of splashes generated by Naval Gun Fire, within the vicinity of the target(s). Multiple aspects of Naval testing, such as Layered Defense Exercises, Track Correlation, Optical Sight/Video Tracker evaluation, and Electronic Warfare require evaluating performance in a splash environment. To accomplish this task, various types of live ordinances may be used as a function of the type of mission and sensors being evaluated. Each type of round generates a splash whose characteristics in terms of size, shape, and height are unique to that round.

The use of live rounds to evaluate sensor performance is a very expensive approach due to the associated hourly cost of Navy ship/Crew at sea, as well as the cost of ordnance and safety vessels to support such effort.

It would thus be desirable to develop a system that enables ordnance splash testing to be conducted for US and FMS Navy vessels. The desired system should enable splash testing to be performed safely at sea or near port, with minimal impact on surrounding people and vessels.

SUMMARY OF THE DISCLOSURE

The disclosed device provides an effective simulation of ordnance splash patterns without the need for firing live ordnance. The device includes a submersible apparatus having the ability to eject air and/or water in desired predetermined patterns to simulate particular types of ordnance. The device allows splash testing to be performed at shore facilities or in port areas, and at reduced cost, since operation of ships at sea is not required. Performing splash testing with the disclosed device also reduces the test load during CSSQT, which allows for enhanced scheduling of other essential tests. The device is applicable to testing performed on any Navy ship Class.

A splash simulation device is disclosed, comprising a submersible frame and a plurality of buoyancy bodies mounted to the submersible frame. The plurality of buoyancy bodies may be capable of maintaining the submersible frame at a desired depth in a body of water. A plurality of fluid flow nozzles are mounted to the frame. The device also includes a fluid source in fluid communication with at least a portion of the plurality of fluid flow nozzles. When the submersible frame is placed in the body of water, at least a portion of the fluid flow nozzles are oriented toward a surface of the body of water.

A submersible device for simulating an ordnance splash is disclosed. The device comprises a frame and a plurality of buoyancy bodies mounted to the frame. The plurality of buoyancy bodies may be capable of providing a buoyancy force to said frame when said frame and bodies are placed in a body of water. The device further comprises a plurality of fluid flow nozzles mounted to the frame, and a fluid source connected to the plurality of fluid flow nozzles. When the submersible frame is placed in said body of water, at least a portion of the plurality of fluid flow nozzles are oriented toward a surface of the body of water to enable creation of a splash at the water surface level when fluid is supplied to the plurality of fluid flow nozzles.

A submersible splash simulation device is disclosed, comprising a frame and a plurality of buoyancy bodies associated with the frame. The plurality of buoyancy bodies are capable of maintaining the frame at a desired level when the frame is placed in a body of water. A plurality of fluid flow nozzles are associated with the frame, and a fluid source is connected to the plurality of fluid flow nozzles for moving fluid through the nozzles. When the submersible frame is placed in said body of water, at least a portion of the plurality of fluid flow nozzles are positioned to create a splash at the water surface level when fluid is moved through the nozzles.

BRIEF DESCRIPTION OF THE DRAWINGS

The details of the invention, both as to its structure and operation, may be obtained by a review of the accompanying drawings, in which like reference numerals refer to like parts, and in which.

DETAILED DESCRIPTION

Figure 1:
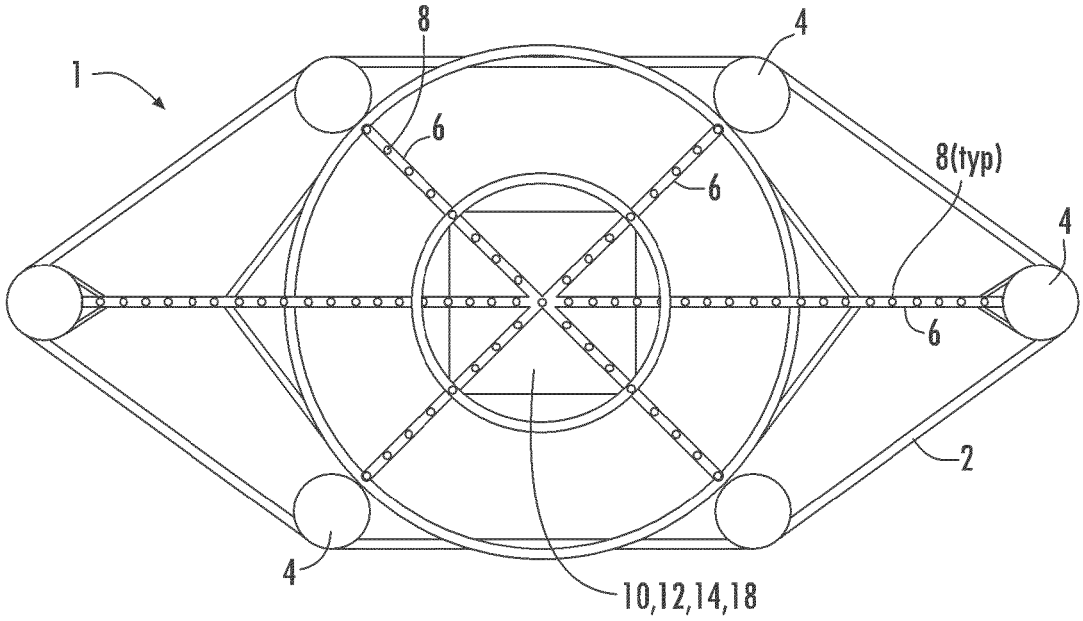
FIG. 1 is a plan view of the disclosed submersible splash simulation device.

In the accompanying drawings, like items are indicated by like reference numerals. This description of the preferred embodiments is intended to be read in connection with the accompanying drawings, which are to be considered part of the entire written description of this invention. In the description, relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

The disclosed submersible splash simulation device provides a simple and inexpensive way to simulate ordnance splashes to facilitate testing of ship sensors such as radar systems. The disclosed device is capable of generating splashes for the purpose of simulating splashes created by rounds from gun fire (e.g., MK45 or other gun type). The device may include multiple air compressor units and/or pumps to generate the desired fluid ejection force, as well as a multiplicity of firing nozzles. The device can be programmable to fire selected nozzles, where each selection of specific nozzles and discharge pressures will simulate a type of ordnance round at different levels of intensity. A remote control unit can be used to program the device and to fire the desired pattern upon request.

In one embodiment, the discharge may consist of water driven by compressed air. In another embodiment, the water may be driven by centrifugal or positive displacement pumps. In a further embodiment, a combination of water and air may be discharged simultaneously from selected nozzles.

Figure 2:
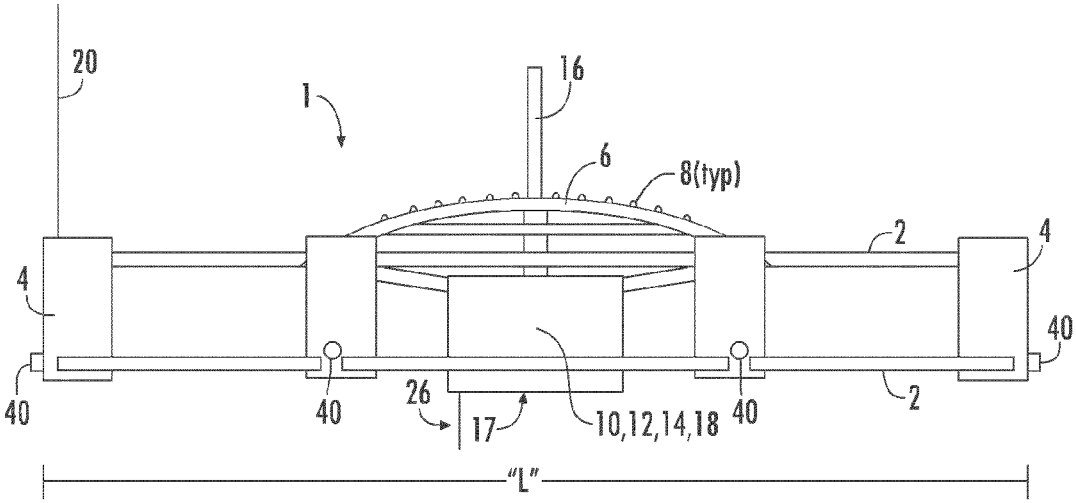
FIG. 2 is a side view of the submersible splash simulation device of FIG. 1

Referring now to FIGS. 1 and 2, the submersible device 1 may comprise a stabilizing truss structure 2 on which a plurality of adjustable buoyancy bodies 4 are mounted. Elongated members 6 run along the top of the truss structure 2 and include a plurality of nozzles 8 through which air, water or a combination thereof can be expelled. In the illustrated embodiment, one elongated member 6 runs the length "L" of the device 1, while two other members 6 are positioned at acute angles thereto. Other arrangements, however, can be used as desired to provide a desired strength and stiffness to the device 1, and also to position the nozzles 8 in a desired pattern.

One or more of the nozzles 8 may be fixed in position, or they may be position adjustable. In addition, the individual orifice size of each of the nozzles may be fixed or adjustable to enable the system to finely control the flow rate of water and/or air expelled from the nozzles. The position and/or orifice size of the nozzles may be locally or remotely controlled.

A housing 10 may be positioned within the truss structure 2. The housing 10 may enclose an air compressor 12 and water pump 14 for supplying fluid to the plurality of nozzles 8. A retractable air vent 16 enables the intake of air to the compressor 12, while a suction intake 17 provides a path for water to enter the water pump 14. The air vent 16 may be retractable so that it does not contribute to radar returns during testing.

Discharge ports of the air compressor 12 and water pump 14 are in fluid communication with the nozzles 8 to enable air, water, or air/water combinations to be pumped through the nozzles 8 to achieve a desired splash effect. In one embodiment, the fluid is supplied to the nozzles using piping or tubing disposed within the elongated members 6. A plurality of air compressors 12 and/or water pumps 14 can be used to provide the desired fluid flow-rates required for a particular application. As an alternative or supplement to the air compressor 12 and/or water pump 14, a source of compressed fluid can be provided, such as compressed air or nitrogen cylinders.

The air compressor 12 and water pump 14 may also be in fluid communication with the adjustable buoyancy bodies 4 to enable water to be introduced and evacuated from the bodies to control the position of the device 1 with respect to the surface of the water. Compressed air may be supplied to the adjustable buoyancy bodies 4 by a combination of pipes and tubes disposed within the elongated members 6. Alternatively, or in addition to, such piping and tubing, the elongated members 6 themselves may be used as flow paths for providing compressed air to the bodies 4.

The adjustable buoyancy bodies 4 may be simple containers that will have the quantities of air and water adjusted to achieve a desired level of buoyancy. The bodies 4 may include internal baffles to reduce instability caused by internal water motion (i.e., sloshing). The device may include electronic level and pressure sensors for one or more of the bodies 4 to determine changes in buoyancy required to maintain the device's attitude as well as height in the water.

The device 1 may also comprise an on-board control system 18 for controlling one or more device operations. The control system 18 may control filling/evacuation of one or more of the buoyant bodies 4 to control the position of the device below the surface of the water to thereby achieve a desired splash effect. In one embodiment, the device will be up to 10 feet below the surface of the water.

The control system 18 may also control the ejection of air and/or water through one or more of the nozzles 8 to simulate a desired ordnance splash. To this end, the control system 18 may be remotely controlled in a "live" fashion so that an operator on an adjacent vessel or on land can command the operation of the device 1 in real time. Alternatively, the control system 18 may be programmed to configure the device 1 into one or more predetermined modes of operation that will simulate one or more ordnance splash patterns.

Figure 3:
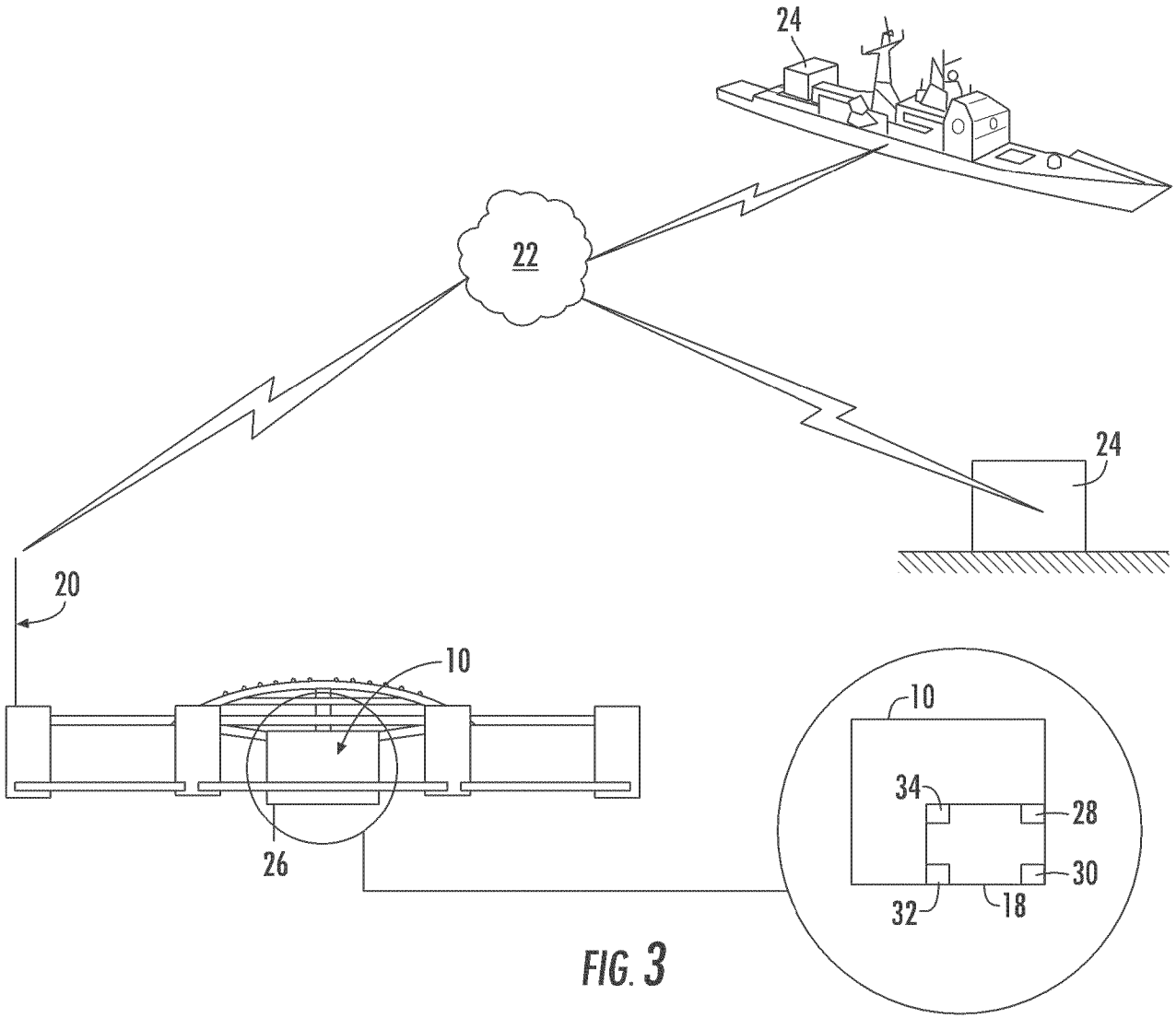
FIG. 3 illustrates the control system for use with the device of FIG. 1.

Referring to FIG. 3, the on-board control system 18 may include a communication link 22 to a remote control system 24 to enable remote control of the device 1 from a nearby ship or on land. The remote control system 24 may automatically or manually forward commands and modes of operation to on-board control system 18 of the device 1. Where a wireless connection is provided, the on-board control system 18 may include one or more antennas 20 mounted on or adjacent to the truss structure 2 and/or the housing 10.

A variety of wireless and hard-wired communications links 22 may be used to remotely control the device 1. In one embodiment, communications between the device 1 and the remote control system 24 may be via VLF (Very Low Frequency) or VHF/UHF (Very High Frequency/Ultra High Frequency) modes. For VLF communications, the device 1 can include an underwater antenna 26 to receive/transmit commands from the remote control system 24. For VHF/UHF communications, the device 1 can include a whip antenna 20 (FIG. 2) protruding above the water to receive/transmit commands from the remote control system 24. Where a whip antenna 20 is used, the radar cross section of the antenna will be such that it is not detectable by radar.

Communications between the device 1 and the remote control system 24 may be one-way or two-way. The remote control system 24 may be an existing communication device aboard a US Navy ship, or it may be a transmitting device specifically designed for communicating with the device 1. The on-board control system 18 may comprise an RF receiving device 28, a computer (i.e., processor 30 with memory 32), and electro-mechanical apparatus 34. The electro-mechanical apparatus 34 may comprise a device that receives control signals from the computer or processor and triggers a desired mechanical function (e.g., turn on/off the air compressor 12 or water pump 14, actuate the nozzles 8, etc.) using a relay, solenoid, or the like.

Figure 4:
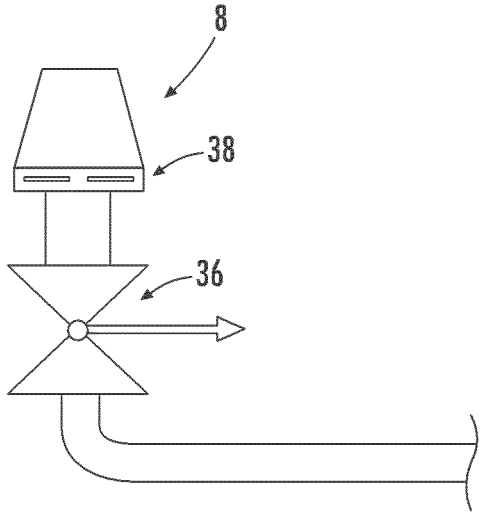
FIG. 4 shows an exemplary nozzle control arrangement for use with the device of FIG. 1.

As previously noted, the control system 18 may control the splashes generated by the system 1. Referring to FIG. 4, each nozzle 8 may be controlled by a valve 36 and a variable orifice 38 to regulate pressure. The valves 36 may be operated by either pneumatic or electric servos. The exact combinations of water and air nozzles to be used for each type of splash may be fine tuned experimentally after initial settings have been determined. This fine tuning may be completed by a manual select mode. Once the combinations are known, the parameters may be used to populate a look up table associated with the processor 30. As additional splash forms are identified, the new splash profiles can be added to the look up table.

As can be seen in FIG. 2, certain of the discharge nozzles 8 are positioned at a level higher than the buoyant bodies 4 to ensure that only the simulated splashes, and not the structure of the device 1, contribute to radar returns of the unit under test. Depending on the type of splash required to simulate a certain type of ordnance, the device 1 may be used in a manner that requires the discharge nozzles 8 to be placed very close to the surface. In this type of use, gentle wave action may expose the buoyant bodies 4 above the water if they are not lower than the nozzles 8. Allowing the buoyant bodies to extend above the water would undesirably change the RF return of the device.

The position of the device in the water will be controlled by anchorage. In alternative embodiments, the device 1 may be position stabilized by use of a GPS navigation system in conjunction with water jets powered by the same pumping system (water pump 14 and/or air compressor 12) that generates splashes, but directed to horizontally aimed nozzles 40 (FIG. 2) capable of providing lateral thrust to move the device in the water.

Portions of the device 1 that will be subjected to the body of water may be constructed of 5000 series corrosion resistant aluminum. Internal piping/tubing may be constructed of stainless steel with fittings of stainless steel or aluminum. The nozzles 8 may be aluminum. All material selections can be made to avoid galvanic cells at interfaces between material types. Sacrificial anodes may be used to reduce corrosive effects of salt water immersion when performing splash testing in seawater or brackish water.

As previously noted, the system 1 can be used to simulate splashes generated by most US and foreign Naval guns. Examples of such US guns include: MK 45-38, 54 and 62 Caliber, MK 38—25 mm, and Phalanx Weapon System—20 mm. Examples of such foreign Naval guns include Bofors—57 mm (Swedish), OTO—Malera 127 mm/54 (5") (Italian), 40 mm/70 OTO-Breda (Italian), and 76 mm/62 (3") (Italian). Air, water or air/water discharges from the system 1 can be used to simulate splashes generated by each of these rounds.

As will be appreciated, the disclosed system provides the ability to conduct thorough testing of ship sensors systems while the ship is in port at reduced cost. Performing the same testing during CSSQT is substantially more costly due to the hourly rate for the ship/crew and the required support vessels presently needed for safety. Conducting this portion of testing outside CSSQT will reduce the required time to perform surface events such as Layered Defense Exercises, Track Correlation, Optical Sight/Video Tracker evaluation, and Electronic Warfare performance in the presence of splashes generated by Naval Gun rounds. In addition, the disclosed system will reduce the test load during CSSQT allows for enhanced scheduling of other essential tests.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A splash simulation device, comprising, a submersible frame including a plurality of elongate support members;

a plurality of buoyancy bodies mounted to the submersible frame;

a plurality of fluid flow nozzles mounted to at least some of the plurality of elongate support members of the frame, at least some of said plurality of fluid flow nozzles positioned at a height on the frame greater than that of the plurality of buoyancy bodies, wherein the plurality of buoyancy bodies are configured to maintain the submersible frame and the plurality of fluid flow nozzles at a desired depth below the surface of a body of water;

and a fluid source, the fluid source being in fluid communication with at least a portion of the plurality of fluid flow nozzles via a plurality of conduits disposed within the at least some of the elongate support members;

wherein when the submersible frame is placed in said body of water and submerged, at least a portion of the fluid flow nozzles are oriented toward the surface of the body of water.

2. The splash simulation device of claim 1, wherein at least a first portion of the fluid flow nozzles are individually position adjustable.

3. The splash simulation device of claim 1, wherein the fluid source comprises at least one of a pump, a compressor, and a compressed fluid cylinder.

4. The splash simulation device of claim 1, further comprising a control system, the control system being configured to control flow of fluid through the plurality of fluid flow nozzles.

5. The splash simulation device of claim 4, wherein the control system is programmed with a series of instructions for controlling flow of fluid through the plurality of fluid flow nozzles in a predetermined manner.

6. The splash simulation device of claim 4, wherein the control system is remotely controllable via a wireless communications link to enable control of the flow of fluid through the plurality of fluid flow nozzles from a location remote from the splash simulation device.

7. A splash simulation device, comprising, a submersible frame;

a plurality of buoyancy bodies mounted to the submersible frame, the plurality of buoyancy bodies capable of maintaining the submersible frame at a desired depth in a body of water;

a plurality of fluid flow nozzles mounted to the frame; and a fluid source, the fluid source being in fluid communication with at least a portion of the plurality of fluid flow nozzles and with at least one of the plurality of buoyancy bodies to enable fluid to be introduced into therein to adjust the depth of the device in the body of water; and wherein, when the submersible frame is placed in said body of water, at least a portion of the fluid flow nozzles are oriented toward a surface of the body of water.

8. The splash simulation device of claim 7, further comprising a control system configured to control ejection of one or more fluids through at least some of the plurality of fluid flow nozzles so as to generate a splash pattern indicative of a given ordnance.

9. The splash simulation device of claim 8, wherein the control system is further configured to control filling and/or evacuation of at least one of the plurality of buoyancy bodies with one or more fluids, to thereby controllably adjust the depth of the device in the water.

10. The splash simulation device of claim 7, wherein the plurality of fluid flow nozzles include adjustable sized orifices.

11. A submersible device for simulating an ordnance splash, comprising:

a submersible frame having a plurality of buoyancy bodies coupled thereto and configured to maintain the submersible frame at a desired depth in a body of water;

a plurality of fluid flow nozzles mounted to the frame;

a fluid flow source connected to the plurality of fluid flow nozzles;

a control system configured to control flow of fluid through the plurality of fluid flow nozzles so as to generate a splash pattern that simulates the splash pattern of a given ordnance, the control system being remotely controllable via a wireless communications link to enable control of the flow of fluid through the plurality of fluid flow nozzles from a location remote from the splash simulation device, wherein at least a portion of the plurality of fluid flow nozzles are oriented toward a surface of the body of water to enable creation of the simulated splash pattern of the given ordnance at the water surface level when fluid is supplied to the plurality of fluid flow nozzles.

12. The submersible device of claim 11, wherein at least a first portion of the fluid flow nozzles are individually position adjustable.

13. The submersible device of claim 11, wherein the fluid source comprises at least one of a pump, a compressor, and a compressed fluid cylinder.

14. The submersible device of claim 11, wherein the control system is programmed with a series of instructions for controlling flow of fluid through the plurality of fluid flow nozzles in a predetermined manner.

15. The submersible device of claim 11, wherein the fluid source is in fluid communication with at least one of the plurality of buoyancy bodies to enable fluid to be introduced into therein to adjust the depth of the device in the body of water.

16. A submersible splash simulation device, comprising, a submersible frame;

a plurality of buoyancy bodies associated with the frame, the plurality of buoyancy bodies capable of maintaining the frame at a desired level when said frame is placed in a body of water;

a plurality of fluid flow nozzles associated with the frame;

a fluid source connected to the plurality of fluid flow for moving fluid through the nozzles; and a control system configured to control the flow of said fluid through the nozzles in a manner so as to generate a splash pattern that simulates the splash pattern of a given ordnance; and wherein at least a portion of the plurality of fluid flow nozzles are positioned to create the splash pattern indicative of the given ordnance at the water surface level when fluid is moved through the nozzles.

17. The submersible device of claim 16, wherein at least a first portion of the fluid flow nozzles are individually position adjustable.

18. The submersible device of claim 16, wherein the fluid source comprises at least one of a pump, a compressor, and a compressed fluid cylinder.

19. The submersible device of claim 16, wherein the control system is programmed with a series of instructions for controlling flow of fluid through the plurality of fluid flow nozzles in a predetermined manner.

20. The submersible device of claim 16, wherein the fluid source is in fluid communication with at least one of the plurality of buoyancy bodies to enable fluid to be introduced into therein to adjust the depth of the device in the body of water.

21. The splash simulation device of claim 16, wherein the plurality of fluid flow nozzles include adjustable sized orifices.

22. The splash simulation device of claim 16, wherein the moving fluid includes air and water.

23. The splash simulation device of claim 16, wherein the control system includes a computer processor and memory operatively coupled thereto, the memory containing one or more splash profiles associated with one or more ordinances for splash simulation.

24. The splash simulation device of claim 23, wherein the one or more splash profiles include data for use by said control system to control nozzle position, nozzle orifice size, nozzle firing time, and pressure regulation.

25. The splash simulation device of claim 16, wherein the control system is further configured to control filling and/or evacuation of at least one of the plurality of buoyancy bodies with one or more fluids, to thereby controllably adjust the depth of the device in the water.

26. The splash simulation device of claim 16, wherein:

the submersible frame includes a plurality of elongate support members; and at least a portion of the plurality of fluid flow nozzles are mounted on the plurality of elongate support members and in fluid communication with the fluid source via a plurality of conduits disposed within the plurality of elongate support members.

27. A splash simulation device, comprising:

a submersible frame;

a plurality of buoyancy bodies mounted to the submersible frame, the plurality of buoyancy bodies capable of maintaining the submersible frame at a desired depth in a body of water;

a plurality of fluid flow nozzles mounted to the frame;

a fluid source, the fluid source being in fluid communication with at least a portion of the plurality of fluid flow nozzles; and a control system being programmable with a series of instructions for controlling flow of fluid through the plurality of fluid flow nozzles in a predetermined manner.

28. The splash simulation device of claim 27, wherein the control system includes a computer processor and memory operatively coupled thereto, the memory containing one or more splash profiles associated with one or more ordinances for splash simulation.

29. The splash simulation device of claim 28, wherein the one or more splash profiles include data for use by said control system to control nozzle position, nozzle orifice size, nozzle firing time, and pressure regulation.

30. The splash simulation device of claim 27, wherein the fluid source is connected to the plurality of fluid flow nozzles via a plurality of conduits disposed within the frame.

31. The splash simulation device of claim 27, wherein the control system is further configured to control filling and/or evacuation of at least one of the plurality of buoyancy bodies with one or more fluids, to thereby controllably adjust the depth of the device in the water.

32. The splash simulation device of claim 27, further comprising at least one retractable air vent disposed within the frame.

33. The splash simulation device of claim 27, wherein:

the submersible frame includes a plurality of elongate support members; and at least a portion of the plurality of fluid flow nozzles are mounted on the plurality of elongate support members and in fluid communication with the fluid source via a plurality of conduits disposed within the plurality of elongate support members.

* * * * *

UNITED STATES PATENT AND TRADEMARK OFFICE

CERTIFICATE OF CORRECTION

PATENT NO. : 8,495,965 B1
APPLICATION NO. : 12/616338
DATED : July 30, 2013
INVENTOR(S) : Joseph Hadida et al.

It is certified that error appears in the above-identified patent and that said Letters Patent is hereby corrected as shown below:

In the Claims:

Column 7, Line 61, Claim 23, last word should read “ordnances”.
Column 8, Line 36, Claim 28, last word should read “ordnances”.

Signed and Sealed this
Seventeenth Day of September, 2013

Teresa Stanek Rea
*Deputy Director of theUnited States Patent and Trademark Office*